US005542226A

United States Patent [19]

Markovich

[11] Patent Number: 5,542,226

[45] Date of Patent: Aug. 6, 1996

[54] ROOFER'S GRID APPARATUS

[76] Inventor: Joseph G. Markovich, 9902 E. 80th Ter., Raytown, Mo. 64138

[21] Appl. No.: 322,581

[22] Filed: Oct. 13, 1994

Related U.S. Application Data

[63] Continuation-in-part of Ser. No. 252,457, Jun. 1, 1994.

[51] Int. Cl.[6] ..... E04D 1/34

[52] U.S. Cl. ..... 52/548; 33/562; 33/648; 52/385; 52/387; 52/551

[58] Field of Search ..... 52/384, 385, 386, 52/387, 547, 548, 551; 33/526, 527, 562, 563, 646, 647, 648, 649

[56] References Cited

U.S. PATENT DOCUMENTS

| | | | |
|---|---|---|---|
| 595,618 | 12/1897 | Gambs . | |
| 1,510,756 | 10/1924 | Ayrault et al. . | |
| 1,557,543 | 10/1925 | Allen | 52/712 |
| 1,668,269 | 5/1928 | Faison . | |
| 1,792,543 | 2/1931 | Livingston et al. | 52/547 |
| 1,890,928 | 12/1932 | Black | 33/649 |
| 1,925,939 | 9/1933 | Sherman . | |
| 1,926,093 | 9/1933 | Gibney et al. | 52/387 |
| 1,980,053 | 11/1934 | Harshberger . | |
| 2,027,029 | 1/1936 | Eckert . | |
| 2,256,313 | 9/1941 | Dexter . | |
| 2,762,130 | 9/1956 | Olson . | |
| 2,816,367 | 12/1957 | Fink et al. | 33/649 |
| 2,882,713 | 4/1959 | Diehl | 52/387 |
| 3,541,745 | 11/1970 | Probst . | |
| 3,763,609 | 10/1973 | Probst . | |
| 4,010,592 | 3/1977 | Nixon . | |
| 4,266,388 | 5/1981 | Flood . | |
| 5,056,234 | 10/1991 | Han . | |

*Primary Examiner*—Michael Safavi
*Attorney, Agent, or Firm*—Hovey, Williams, Timmons & Collins

[57] ABSTRACT

A roofer's grid apparatus is provided for use in retaining shingles on a roof. The apparatus includes several mounting strips of support material which are secured together by horizontal connecting strips so that the mounting strips are parallel to and spaced from one another. A plurality of shingle retaining arrays are provided on the mounting strips for retaining shingles on the apparatus with the shingles arranged in horizontal courses and with each course overlapping the course beneath. Each array includes a pair of raised ears connected to the mounting strips and being spaced horizontally from one another by a distance adapted to be substantially equal to the length of a shingle, and a plurality of spurs protruding from the strips and adapted to penetrate the shingle when the shingle is positioned between the ears and pressed against the roof.

3 Claims, 4 Drawing Sheets

10
14
18
24
26
28
30
32
34
36
38
42

ROOFER'S GRID APPARATUS

RELATED APPLICATIONS

The present application is a Continuation-in-Part of U.S. patent application Ser. No. 08/252,457, filed 1 Jun. 1994, by Markovich, and entitled Roofer's Grid Apparatus.

BACKGROUND OF THE INVENTION

1. Field of the Invention

The present invention relates generally to roofing materials and, more particularly, to a grid for use in retaining shingles on a roof.

2. Discussion of the Prior Art

A conventional roof construction includes roof sheeting material, such as plywood, which is nailed to the rafters defining a roof. A layer of waterproof material, such as an asphalt impregnated felt material, is applied over the sheeting, and is covered by shingles which are applied in horizontal courses from the bottom edge of the roof up, with each course overlapping the one beneath.

A common type of shingle used in this roof construction is known as a strip shingle, and includes a strip of asphaltic or fiberglass impregnated material having, for example, a length of three feet, a width of twelve inches, and a thickness of between one-eighth to one-half inches. Slits are provided along one edge of the strip and extend inward laterally to provide an impression that a plurality of shingles are included in each strip. In addition, an aggregate material is applied over one face of the strip to texture the surface and to provide a desired appearance. The material used in strip shingles typically possesses a degree of flexibility such that the shingles may be bent, rolled or otherwise worked, if necessary.

Attempts have been made to simplify installation of shingles on a roof by guiding alignment of the shingles or by presenting fastening expedients for holding the shingles in place once positioned. However, such conventional attempts have either fallen short of obtaining both of these goals, or require the use of specially-made shingles, increasing the cost of the system.

OBJECTS AND SUMMARY OF THE INVENTION

An object of the present invention is to provide a grid apparatus that can be attached to a roof prior to installation of the shingles, and that automatically aligns the shingles as they are installed. The apparatus also retains the shingles on the roof without requiring the use of any additional fasteners.

It is another object of the present invention to provide a grid apparatus that simplifies installation of the roof and reduces the time required to complete the construction. This object is obtained while also permitting individual installation, removal and replacement of conventional shingles at any time, without affecting surrounding shingles.

In accordance with these and other objects evident from the following description of a preferred embodiment of the invention, a roofer's grid apparatus is provided for use in retaining shingles on a roof. The apparatus includes a plurality of mounting strips of support material, and a plurality of horizontal connecting strips of support material connecting the mounting strips together in a configuration in which the mounting strips are parallel to and spaced from one another. The apparatus is also provided with a means for permitting the strips to be secured to the roof, and a plurality of shingle retaining means for retaining shingles on the apparatus with the shingles arranged in horizontal courses, wherein each course overlaps the course beneath.

Each shingle retaining means of the inventive apparatus includes a pair of raised ears connected to the mounting strips and spaced horizontally from one another by a distance adapted to be substantially equal to the length of a shingle, and a plurality of spurs protruding from the strips and adapted to penetrate the shingle when the shingle is positioned between the ears and pressed against the roof. The ears and spurs of each shingle retaining means are arranged in an array, wherein the arrays are arranged in staggered rows, with the arrays of any given row being offset from the arrays in adjacent rows.

By providing a construction in accordance with the present invention, numerous advantages are realized. For example, by providing an apparatus including shingle retaining means arranged in staggered rows across the area of the apparatus, it is possible for several roofers to simultaneously install shingles at different locations across the lowest uncompleted course of the roof. With conventional methods, it is necessary to lay each course from one end to the other in order to align the shingles end-to-end.

Another advantage resides in the ability to remove any desired shingle from the roof in order to replace the shingle. For example, if certain shingles are damaged by hail, those shingles may be pulled from the grid apparatus and replaced without reconstruction of the surrounding areas.

In accordance with one preferred construction of the inventive apparatus, a layer of waterproof material is connected to the grid apparatus. By employing this construction, fewer steps are required to complete the roof, and it is possible to locate rafters of the roof and to fasten the apparatus directly to those rafters. Thus, the grid can be securely held against the roof to withstand any live loads exerted on the grid after installation.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 1:
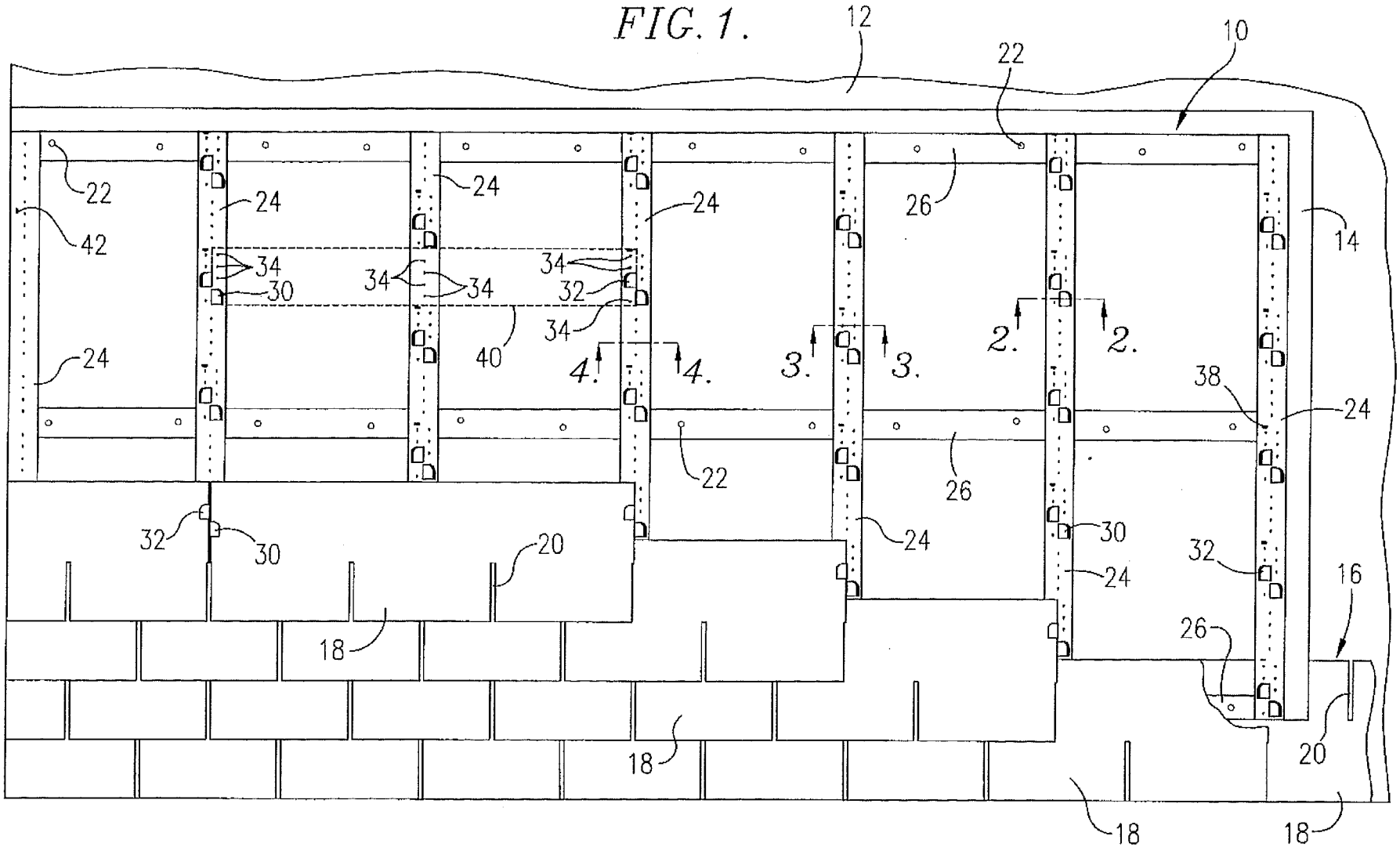
FIG. 1 is a front elevational view of a roof, illustrating a grid apparatus, constructed in accordance with the preferred embodiment.

A roof in progress is illustrated in FIG. 1, wherein a grid apparatus 10 constructed in accordance with a preferred embodiment of the present invention is employed. The roof includes a layer of conventional roof sheeting 12, such as plywood or the like, which has been applied over and attached to the rafters, and a layer of waterproof material 14, such as a felt material impregnated with asphalt or the like. Normally, the waterproof material 14 is applied to the roof sheeting, and then a lowermost course 16 of shingles 18 is secured in place along the lower edge of the roof. This lower course 16 of shingles is inverted so that the slits 20 formed in the shingles 18 face upward. Thereafter, the grid apparatus 10 is positioned on the roof and secured in place by nails or screws 22, or any other means desired.

The grid apparatus 10 generally includes seven vertical mounting strips 24 of support material, such as sheet metal or the like, and three horizontal connecting strips 26 formed of the same support material. The horizontal connecting strips 26 extend between and are connected to the mounting strips, as by spot welds 28 shown in FIG. 6. The horizontal strips position the mounting strips parallel to one another. The horizontal strips are spaced from one another along the lengths of the vertical mounting strips so that a rigid lattice results, and the mounting strips are spaced from one another by a center-to-center distance adapted to be equal to about one-half the length of a shingle to be used with the apparatus. For example, if the grid apparatus is constructed for use with conventional strip shingles having a length of three feet, a width of twelve inches, and a thickness of one-eighth inch, the vertical strips are spaced one and one-half feet from one another, center-to-center.

A plurality of shingle retaining means are provided on the mounting strips 24 for retaining shingles 18 on the apparatus with the shingles arranged in horizontal courses and with each course overlapping the course beneath. Each shingle retaining means includes a pair of raised ears 30, 32 connected to the vertical strips and being spaced horizontally from one another by a distance adapted to be substantially equal to the length of a shingle, e.g. three feet. Each shingle retaining means also includes a plurality of spurs 34 protruding from the strips 24 and adapted to penetrate a shingle when the shingle is positioned between the ears and pressed against the roof.

Figures 2, 3, 4, 5, 6:
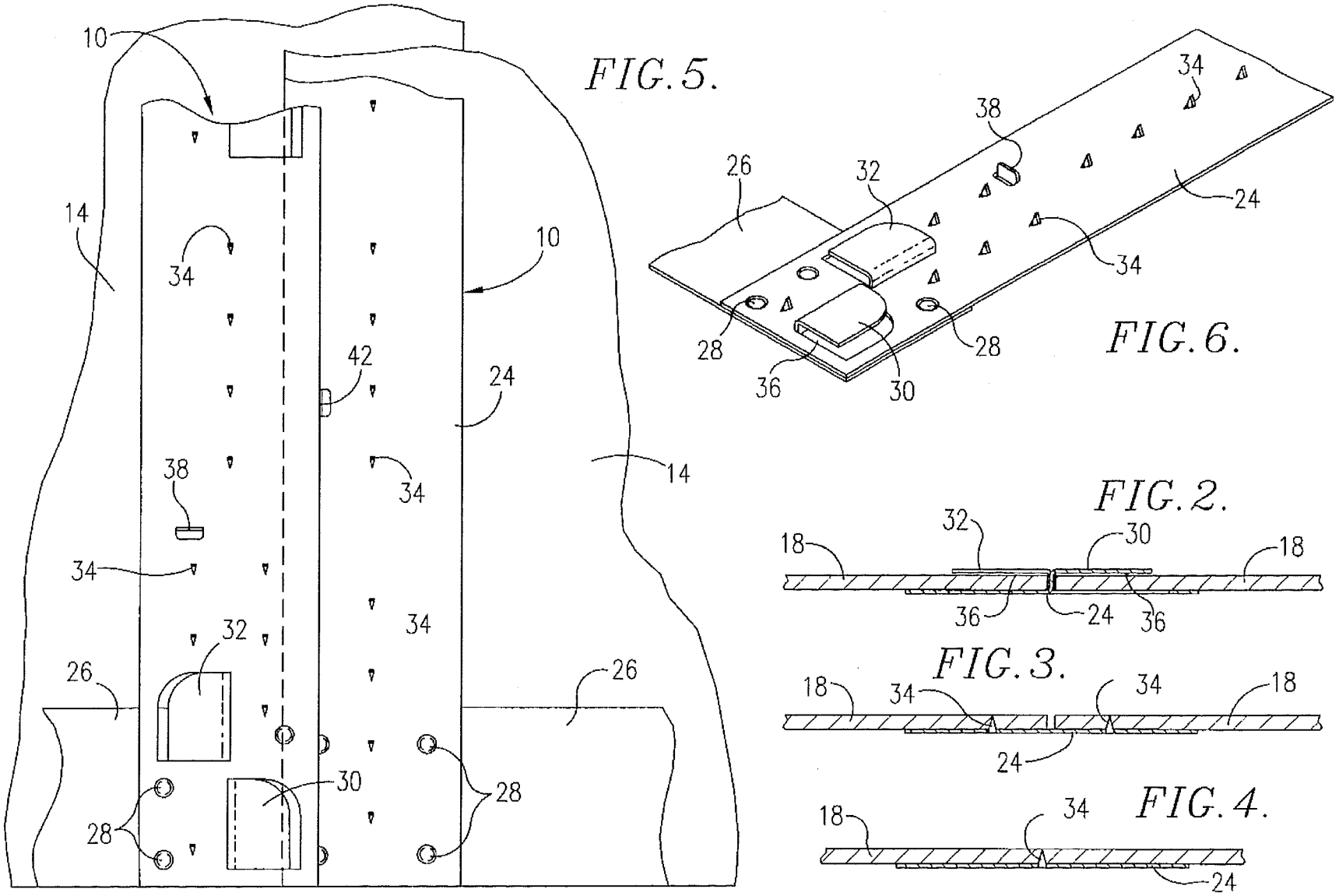
FIG. 2 is a sectional view taken along line 2—2 of FIG. 1.
FIG. 3 is a sectional view taken along line 3—3 of FIG. 1.
FIG. 4 is a sectional view taken along line 4—4 of FIG. 1.
FIG. 5 is a fragmentary elevational view of the lower right-hand corner of the apparatus, illustrating the apparatus aligned side-by-side with a second apparatus of similar construction.
FIG. 6 is a fragmentary perspective view of the lower right-hand corner of the apparatus, illustrating various details of the preferred embodiment.

As shown in FIG. 6, each ear 30, 32 is formed from the support material of one of the mounting strips, and preferably includes a tongue of material which has been punched and bent from the strip so that the ear is spaced from the strip by a distance of one-eighth to one-half inch. This spacing is selected based upon the type of shingle to be used with the apparatus, and is designed to present a slot 36, as shown in FIG. 2, within which an edge of a shingle 18 may be received. For example, if the apparatus is to be used with shingles having a thickness of one-eighth inch, then the slot should be about the same size. Alternately, the ears may be punched from the strip so that they stand straight up at an angle of 90° to the strip. With this construction, the ears are bent over onto the shingle after it has been positioned on the apparatus.

As shown in FIG. 5, although the tongue of material forming each ear is generally rectangular in shape, the upper corner of the free end of the ear may be radiused to simplify installation of shingles. However, the lower corner of the free end of each ear is square so that the ear holds the underlying shingle against the roof and prevents lifting.

The spurs 34 are also formed from tongues of material which have been punched from the strips so that the spurs protrude from the strips in a direction generally perpendicular thereto. The spurs 34 are between one-eighth and one-half inches long, and are pointed at the free ends so that they will penetrate a shingle when the shingle is positioned between the ears and pressed against the roof.

Each shingle retaining means also includes a tab 38 defining a stop against which the upper edge of a shingle rests when the shingle is positioned properly between the ears. Preferably, the tabs 38 are formed of small rectangular tongues of material that have been punched from the vertical strips so that they protrude upward in a direction generally perpendicular to the strips.

The ears 30, 32, spurs 34 and tab 38 of each shingle retaining means are arranged in an array covering a rectangular area extending across at least a portion of three of the mounting strips 24. The area covered by a single array is denoted by the dashed line 40 in FIG. 1, and is of a length of three feet and a height of five inches. The length of the array corresponds to the length of a shingle to be used with the apparatus, and the width of the array corresponds to the portion of the width of the shingle that does not overlap the underlying shingle in the course immediately beneath it. In the embodiment illustrated in FIG. 1, ten rows of arrays are provided on the grid apparatus, and each row is of a length slightly less than the length of three arrays, and a width of about five inches.

Looking at the single array denoted by the line 40, it is seen that the array includes an ear 30 and three spurs 34 on the left-most strip, an opposing ear 32 and three spurs 34 on the right-most strip, along with the tab 38, and four spurs 34 centrally located on the intermediate strip. Thus, ten spurs in total are provided within the array for retaining a shingle in place once the shingle is received within the slots defined by the ears 30, 32. Fewer spurs could be provided if desired, as could a greater number. However, the essential consideration is that a sufficient number of spurs be provided to support any predicted live load to be supported by the shingles.

Although only one tab 38 is illustrated for each array, additional tabs could be provided if necessary, to guide installation of shingles. It is noted that the ear 30 on the left-most strip of each array serves as a stop for the array immediately beneath it. Thus, even if additional tabs are not used, these ears guide placement of shingles along the adjacent row of arrays.

In accordance with one aspect of the invention, the layer of waterproof material 14 normally provided between the roof sheeting and the shingles may be attached directly to the grid apparatus 10 during manufacture so that when the grid apparatus is installed, a waterproof layer is applied to the roof. Thus, the number of steps required to construct the roof is reduced. In addition, by installing the grid apparatus and waterproof material to the roof simultaneously, the mounting strips of the grid apparatus may be aligned with the rafters underlying the sheeting so that the apparatus may be secured directly to the rafters. It may be difficult to locate the rafters where the waterproof material has been previously installed.

As shown in FIG. 1, if the waterproof material 14 is provided on the grid apparatus, it should cover the entire area of the apparatus. In addition, the waterproof material extends beyond one side edge of the apparatus and beyond the top edge thereof. As shown in FIG. 5, when this construction is employed, and when two grid apparatuses of similar construction are aligned with one another on the roof, the waterproof material of one apparatus overlaps the waterproof material of the other apparatus to prevent leakage.

An additional feature of the grid apparatus includes the provision of an alignment means for aligning the grid apparatus with a second apparatus of similar construction. This alignment means is provided on the left-most mounting strip of the apparatus, and includes a plurality of tabs 42 punched from the strip material to define stops against which the adjacent apparatus rests when the two apparatuses are aligned with one another. The left-most strip differs from the other vertical strips in that it is provided only with spurs 34 and tabs 42, and does not include any ears 30, 32. This construction of the grid apparatus permits two or more apparatuses of similar construction to be aligned with one another side-by-side without interrupting the pattern of arrays from one to the next apparatus.

In order to install a roof using the grid apparatus, a roofer first installs a lowermost course 16 of inverted shingles 18 so that the slits 20 formed in the shingles extend inward from the upper edge of the shingles rather than from the lower edge. Thereafter, a grid apparatus 10 is positioned on the roof overlapping the lowermost course by about five inches so that the first course of shingles laid onto the apparatus is aligned with the lowermost course. As shown in FIG. 5, additional grid apparatuses are aligned with the first grid, with the leftmost mounting strip of each grid sandwiched between the waterproof material 14 and the rightmost mounting strip 24 of the adjacent apparatus.

Although not shown, when a grid apparatus is to be aligned above an adjacent apparatus, the lowermost horizontal connecting strip is simply aligned with the uppermost connecting strip of the underlying grid apparatus, and the waterproof material of the upper apparatus overlaps the waterproof material of the lower apparatus.

Once the grid apparatuses are installed, or as they are installed, it is possible to begin placing shingles 18 along the lowermost row of arrays provided on each apparatus. Each shingle 18 is positioned on the apparatus by bending the shingle inward from the ends and urging the edges of the shingle beneath the ears into the position shown in FIG. 2. Thereafter, the shingle is pressed against the roof so that the spurs penetrate the shingle to hold it in place, as shown in FIG. 4. The spurs that are aligned vertically with the ears 30, 32 of each array also penetrate the shingles, as shown in FIG. 3.

Because the alignment of the shingles is automatic, it is not necessary to work in only one direction across the roof, as with conventional methods. Instead, it is possible to work in either horizontal direction and to install the shingles of each course in any desired order before proceeding with installation of shingles in the next course.

If it is necessary to install a shingle along an edge of the roof, and an entire array is not available to retain the shingle in place, it is possible to finish the edge of the roof by using conventional methods of cutting the shingles to length along the edge of the roof and nailing them in place. Thus, some custom finishing will usually be required.

Once installation of a roof is complete, it is possible to go back and replace a shingle if necessary, simply by lifting the shingle from the spurs and pulling it from between the ears. A new shingle may then be installed.

Figure 7:
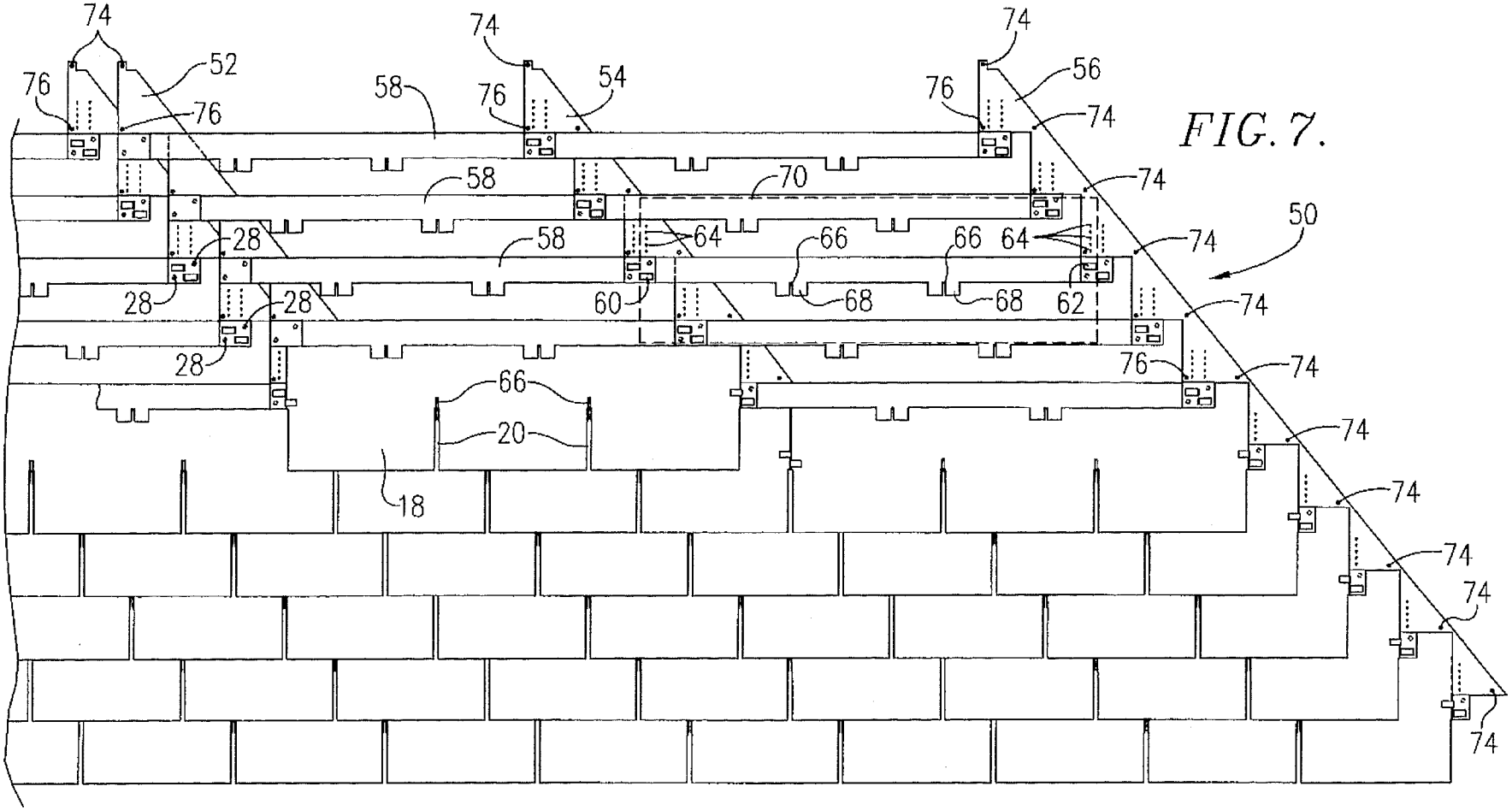
FIG. 7 is a front elevational view of a grid apparatus constructed in accordance with another aspect of the preferred embodiment.
Figure 8:
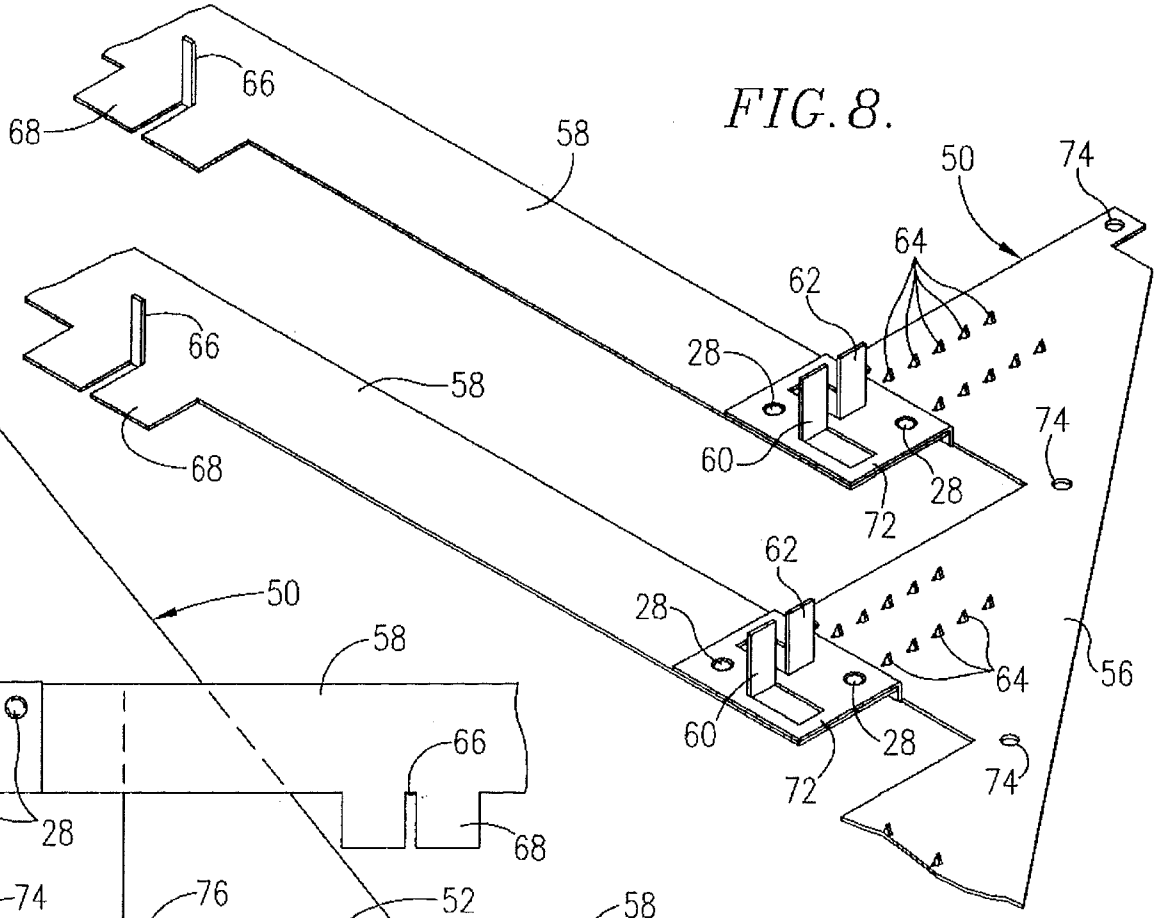
FIG. 8 is a fragmentary perspective view of the grid apparatus of FIG. 7.
Figure 9:
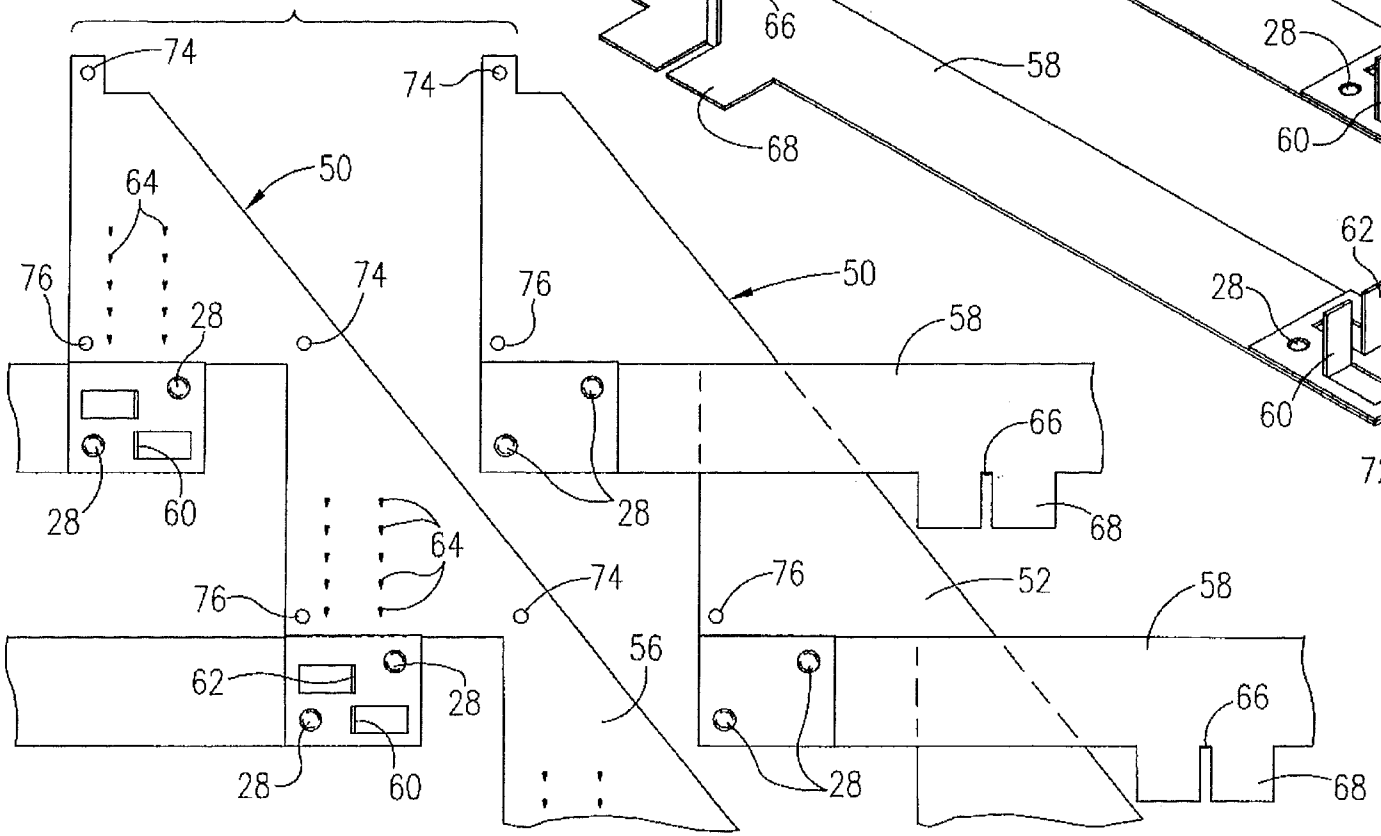
FIG. 9 is a fragmentary front elevational view of a corner of the apparatus, illustrating the apparatus aligned side-by-side with a second apparatus of similar construction.

A grid apparatus constructed in accordance with an alternate aspect of the preferred embodiment is illustrated in FIGS. 7–9. As shown in FIG. 7, the apparatus 50 generally includes three angled mounting strips 52, 54, 56 of support material, such as sheet metal or the like, and ten horizontal connecting strips 58 formed of the same support material. The horizontal connecting strips 58 extend between and are connected to the mounting strips, as by spot welds 28 shown in FIG. 8, and position the mounting strips parallel to one another at an angle of about 45° relative to the horizontal strips.

The connecting strips 58 are spaced from one another by a center-to-center distance of about five inches and are each connected to each of the mounting strips so that a rigid lattice results. The intermediate and right-hand mounting strips 54, 56 are spaced from one another by a center-to-center distance adapted to be equal to the length of a shingle to be used with the apparatus, and the left-hand strip 52 is spaced from the intermediate strip 54 by a distance of less than the length of a shingle so that it is possible to position the grid apparatus beside a second apparatus of similar construction without interrupting the spacing between shingles extending across the side-by-side apparatuses.

For example, if the grid apparatus is constructed for use with conventional strip shingles having a length of three feet, a width of twelve inches, and a thickness of one-eighth inch, the mounting strips 54, 56 are spaced 36 inches from one another, center-to-center, while the mounting strips 52, 54 are spaced 33.25 inches apart. This construction allows two grid apparatuses of identical construction to be positioned beside one another with the right-hand mounting strip 56 of the left-hand apparatus and the left-hand strip 52 of the right-hand apparatus overlapping, as shown in FIG. 7, to define a means for retaining shingles in place on the roof between the right-hand strip of the left-hand apparatus and the intermediate strip of the right-hand apparatus.

A plurality of shingle retaining means are provided on the apparatus 50 for retaining shingles 18 on the apparatus with the shingles arranged in horizontal courses and with each course overlapping the course beneath. Each shingle retaining means includes a pair of raised ears 60, 62 formed in the mounting strips 52, 54, 56 and being spaced horizontally from one another by a distance adapted to be substantially equal to the length of a shingle, e.g. three feet. Each shingle retaining means also includes a plurality of spurs 64 protruding from the strips 58 and adapted to penetrate a shingle when the shingle is positioned between the ears and pressed against the roof.

As shown in FIG. 8, each ear 60, 62 is formed from the support material of one of the mounting strips, and preferably includes a tongue of material which has been punched and bent from the strip so that the ear extends perpendicular to the strip. This construction permits the ears to be folded over onto a shingle after the shingle is positioned on the apparatus. Thus, the apparatus is capable of accommodating shingles of any thickness without requiring modification of the apparatus.

The spurs 64 are also formed from tongues of material which have been punched from the strips so that the spurs protrude from the strips in a direction generally perpendicular thereto. The spurs 64 are between one-eighth and one-half inches long, and are pointed at the free ends so that they will penetrate a shingle when the shingle is positioned between the ears and pressed against the roof. If desired, additional spurs may be provided on the strips 52, 54, 56 or 58, and may be directed either upward or downward in order to facilitate securing of the shingles on the apparatus upon installation of the shingles.

Each shingle retaining means also includes a pair of tabs 66 provided on the connecting strip 58 aligned vertically with and extending between the tabs. Each connecting strip 58 includes a pair of transverse fingers 68 protruding toward the lower edge of the apparatus at positions adapted to be aligned with the slits of a conventional shingle when such a shingle is positioned on the apparatus between the ears 60, 62 of the shingle retaining means. Each of these fingers is provided with one of the tabs of material which has been punched and bent from the finger so that the tab extends upward in a direction perpendicular to the connecting strip.

The tabs are between one-half and two inches long so that they may be guided through the slits of a shingle and folded over on top of the shingle to hold it in place. Preferably, the tabs are spaced one foot apart from each other along the strip 58, and each tab is spaced one foot from the nearest ear of the shingle retaining means.

The ears 60, 62, spurs 64 and tabs 66 of each shingle retaining means are arranged in an array covering a rectangular area extending horizontally across two of the mounting strips 52, 54, 56 and vertically across the width of one of the connecting strips 58 and the space between the connecting strip and the next adjacent connecting strip above it. The area occupied by a shingle retained in an array is denoted by the dashed line 70 in FIG. 7.

Looking at the area denoted by the line 70, it is seen that the array includes an ear 60 and five spurs 64 on the intermediate strip 54, an opposing ear 62 and five spurs 64 on the right-hand strip 56, and the two tabs 66 formed in the connecting strip extending between the ears. As mentioned, additional spurs may be provided on the connecting strip 58 for retaining a shingle in place once the shingle is received between the ears 60, 62. Also, fewer spurs could be provided if desired. However, the essential consideration is that a sufficient number of spurs be provided to support any predicted live load to be supported by the shingles.

As shown in FIG. 8, the horizontal connecting strips 58 and the ears 60, 62 formed in each mounting strip are raised relative to the mounting strips by a height sufficient to permit receipt of a shingle on the apparatus beneath each connecting strip. Preferably, the mounting strips 52, 54, 56 include lugs 72 to which the connecting strips are attached, e.g. by the spot welds 28, and the lugs are bent upward and over to establish the size of the gap between the connecting strips and the mounting strips. The ears 60, 62 are formed in these lugs so that they are not covered by a shingle when the shingle is inserted beneath the connecting strip, and are available for use in securing another shingle in place overlapping the underlying shingle inserted beneath them.

By angling the mounting strips 52, 54, 56 relative to the connecting strips 58, and by spacing the lugs 72 of each strip horizontally from one another, each row of arrays is staggered relative to the rows above and below it. Preferably, the lugs on each mounting strip are spaced horizontally from one another by a center-to-center distance of four or five inches, depending upon the amount of horizontal offset desired between courses. However, the horizontal spacing of the lugs may be of any desired spacing, or may be varied from one to the next in order to provide a non-uniform staggered relationship that is preferred for certain types of roofing materials.

As with the embodiment described above, it is possible to provide a layer of waterproof material on the grid apparatus so that the grid apparatus and waterproof layer may be installed on a roof simultaneously. When such a layer is applied to the apparatus, the waterproof material extends beyond one side edge of the apparatus and beyond the top edge thereof. When this construction is employed, and when two grid apparatuses of similar construction are aligned with one another on the roof, the waterproof material of one apparatus overlaps the waterproof material of the other apparatus to prevent leakage.

An additional feature of the grid apparatus includes the provision of an alignment means for aligning the grid apparatus with a second apparatus of similar construction that is positioned either beside, above or below the first apparatus. This alignment means includes a plurality of holes 74 formed along the edges of each mounting strip 52, 54, 56, and permits one apparatus to be aligned with another simply by aligning certain of the holes of each apparatus with holes provided on the other, as shown in FIG. 9, and securing both apparatuses to the roof. Such alignment automatically presents staggered rows of shingle retaining arrays across the apparatuses without interruption.

It is noted that the left-hand mounting strip 52 does not include tabs formed in the lugs to which the connecting strips are welded, but that these lugs are flat. This construction is preferred because such ears are not necessary. However, ears could be provided in the lugs if desired, and then simply folded over prior to use if not needed.

In order to install a roof using the grid apparatus, a roofer first installs a lowermost course of inverted shingles so that the slits formed in the shingles extend inward from the upper edge of the shingles rather than from the lower edge, as described above. Thereafter, one or more grid apparatuses 50 are positioned on the roof overlapping the lowermost course by about five inches so that the first course of shingles secured to each apparatus is aligned with the lowermost course.

Although not shown, when a grid apparatus is to be aligned above an adjacent apparatus, the lowermost holes 74 in the upper grid are simply aligned with the uppermost holes of the underlying grid apparatus, and the apparatuses are secured to the roof, e.g. by driving nails or screws through the holes.

Once the grid apparatuses are installed, or as they are installed, it is possible to begin placing shingles 18 along the lowermost row of arrays provided on each apparatus. Each shingle 18 is positioned on the apparatus by inserting the shingle beneath the connecting strip 58 that is spaced upward along the mounting strip from the array, and by pressing the shingle against the apparatus between the ears 60, 62 so that the spurs 64 engage the shingle to hold it in place. Thereafter, the ears are folded down onto the shingle to hold the side edges of the shingle in place, and the tabs 66, which extend upward through the slits 20 of the shingle, are folded over on top of the shingle to hold it down.

Thus, each shingle 18 is held in place through the cooperation of four different means: The shingle is inserted beneath a connecting strip and is held by the strip against the roof. The shingle is retained in position by the spurs 64 which penetrate the shingle to hold it in place. The ears 60, 62 of each array are folded over onto the shingle to hold the side edges of the shingle down. And, the tabs 66 protrude up through the slits of the shingle and are folded over onto the shingle to prevent the shingle from lifting off of the apparatus.

As each subsequent course of shingles are installed on the apparatus, the overlying shingles cover the grid apparatus components that are used to secure the underlying shingle in place so that none of the grid apparatus is substantially exposed upon completion of installation of the roof.

Because the alignment of each shingle on the apparatus is automatic, it is not necessary to work in only one direction across the roof, as with conventional methods. Instead, it is possible to work in either horizontal direction and to install the shingles of each course in any desired order before proceeding with installation of shingles in the next course.

If it is necessary to install a shingle along an edge of the roof, and an entire array is not available to retain the shingle in place, it is possible to finish the edge of the roof by using conventional methods of cutting the shingles to length along the edge of the roof and nailing them in place. Thus, some custom finishing will usually be required.

Once installation of a roof is complete, it is possible to go back and replace a shingle if necessary, simply by bending back the ears 60, 62 and the tabs 66, and lifting the shingle from the spurs 64 and pulling it from beneath the connecting strip 58 that extends over the upper edge of the shingle. A new shingle may then be installed.

One variation that may be employed with the grid apparatus includes the use of additional spurs along the horizontal connecting strips, wherein the spurs protrude downward from the fingers 68 to engage an underlying shingle that is inserted beneath the strip. For example, some shingles do not include slits for receiving the tabs 66, and these shingles may be retained on the apparatus by providing such downward directed spurs for holding the shingles in place. When such a construction is employed, no tabs are formed on the fingers, and the fingers are constructed of a length sufficient to protrude about halfway down the width of a shingle that is inserted beneath the strip. This construction permits reliable retention of the shingles on the apparatus.

Although the invention has been described with reference to the preferred embodiment illustrated in the attached drawing figures, it is noted that substitutions may be made and equivalents employed herein without departing from the scope of the invention as recited in the claims.

What is claimed is:

1. A roofer's grid apparatus adapted for use in retaining shingles on a roof, wherein the shingles are of a predetermined length, the apparatus comprising:

a plurality of mounting strips of support material;

a plurality of horizontal connecting strips of support material securing the mounting strips together in a configuration in which the mounting strips are parallel to and spaced from one another, the connecting strips being raised relative to the mounting strips by a distance sufficient to receive a shingle beneath the connecting strip; and a plurality of shingle retaining means provided on the mounting strips for retaining shingles on the apparatus in horizontal courses each overlapping the course beneath, each shingle retaining means including a pair of raised ears connected to the mounting strips and being spaced horizontally from one another by a predetermined distance, and a plurality of spurs protruding from the strips and adapted to penetrate the shingle when the shingle is positioned between the ears and pressed against the roof, the ears and spurs of each shingle retaining means being arranged in an array, wherein the arrays are arranged in staggered rows and the arrays of any given row are offset from the arrays in adjoining rows.

2. A roofer's grid apparatus adapted for use in retaining shingles on a roof, wherein the shingles are of a predetermined length, the apparatus comprising:

a plurality of mounting strips of support material;

a plurality of horizontal connecting strips of support material securing the mounting strips together in a configuration in which the mounting strips are parallel to and spaced from one another, the mounting and connecting strips being connected together by welding; and a plurality of shingle retaining means provided on the mounting strips for retaining shingles on the apparatus in horizontal courses each overlapping the course beneath, each shingle retaining means including a pair of raised ears connected to the mounting strips and being spaced horizontally from one another by a predetermined distance, and a plurality of spurs protruding from the strips and adapted to penetrate the shingle when the shingle is positioned between the ears and pressed against the roof, the ears and spurs of each shingle retaining means being arranged in an array, wherein the arrays are arranged in staggered rows and the arrays of any given row are offset from the arrays in adjacent rows.

3. A roofer's grid apparatus adapted for use in retaining shingles on a roof, wherein the shingles are of a predetermined length, the apparatus comprising:

a plurality of mounting strips of sheet metal;

a plurality of horizontal connecting strips of sheet metal securing the mounting strips together in a configuration in which the mounting strips are parallel to and spaced from one another; and a plurality of shingle retaining means provided on the mounting strips for retaining shingles on the apparatus in horizontal courses each overlapping the course beneath, each shingle retaining means including a pair of raised ears connected to the mounting strips and being spaced horizontally from one another by a predetermined distance, and a plurality of spurs protruding from the strips and adapted to penetrate the shingle when the shingle is positioned between the ears and pressed against the roof, the ears and spurs of each shingle retaining means being arranged in an array, wherein the arrays are arranged in staggered rows and the arrays of any given row are offset from the arrays in adjacent rows.

* * * * *